US006560420B2

(12) United States Patent
Yagi et al.

(10) Patent No.: US 6,560,420 B2
(45) Date of Patent: May 6, 2003

(54) ELECTROPHOTOGRAPHIC DEVICE FOR TRANSFERRING A PLURAL COLOR TONER IMAGE

(75) Inventors: Hitoshi Yagi, Kanagawa (JP); Isao Takasu, Kanagawa (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 0 days.

(21) Appl. No.: 09/953,268

(22) Filed: Sep. 17, 2001

(65) Prior Publication Data

US 2002/0048464 A1 Apr. 25, 2002

(30) Foreign Application Priority Data

Sep. 18, 2000 (JP) ..... 2000-282236

(51) Int. Cl.[7] ..... G03G 15/02; G03G 15/043; G03G 15/08; G03G 15/10

(52) U.S. Cl. ..... 399/50; 399/51; 399/53; 399/57

(58) Field of Search ..... 399/50, 51, 53, 399/57, 223, 231, 233, 237, 298, 301, 302, 307

(56) References Cited

U.S. PATENT DOCUMENTS

| | | | | |
|---|---|---|---|---|
| 4,370,047 A | | 1/1983 | Damouth et al. | |
| 4,403,848 A | | 9/1983 | Snelling | |
| 4,660,503 A | | 4/1987 | Jones | |
| 4,728,983 A | | 3/1988 | Zwadlo et al. | |
| 5,176,974 A | | 1/1993 | Till et al. | |
| 5,276,492 A | | 1/1994 | Landa et al. | |
| 5,408,299 A | | 4/1995 | Haas | |
| 5,557,377 A | | 9/1996 | Loewen et al. | |
| 5,570,173 A | | 10/1996 | Nye et al. | |
| 5,978,629 A | * | 11/1999 | Stover | 399/237 |

FOREIGN PATENT DOCUMENTS

| | | |
|---|---|---|
| JP | 58-66953 | 4/1983 |
| JP | 63-54184 | 10/1988 |

OTHER PUBLICATIONS

H. Yagi, et al., International Conference on Digital Printing Technologies, pp. 246–250, "Image–on–Image Color Process Using Liquid Toner", 2000.

M. Hosoya, et al., pp. 107–114, "Xerographic Development Using Mono–Component Non–Magnetic Toner", Jan. 30, 1987.

M. Hosoya, et al., Japan Hardcopy 2000, pp. 161–164, "Image–on–Image (=IOI) Color Process Using Liquid Toner", 2000 (with English Abstract).

* cited by examiner

*Primary Examiner*—William J. Royer
(74) *Attorney, Agent, or Firm*—Oblon, Spivak, McClelland, Maier & Neustadt, P.C.

(57) ABSTRACT

An electrophotographic device includes a control section configured to control operations of a charging unit, an exposure unit, and other units to satisfy a desired condition.

18 Claims, 2 Drawing Sheets

ELECTROPHOTOGRAPHIC DEVICE FOR TRANSFERRING A PLURAL COLOR TONER IMAGE

CROSS-REFERENCE TO RELATED APPLICATION

This application claims benefit of priority under 35 USC §119 to Japanese Patent Application No. P2000-282236, filed on Sep. 18, 2000, the entire contents of which are incorporated herein by reference.

BACKGROUND OF THE INVENTION

1. Field of the Invention

The present invention relates to an electrophotographic device capable of printing high quality images on a receptor sheet (or a copy sheet) with high speed.

2. Description of the Related Art

Recently, there is a strong demand for printing high quality color images with high speed following the progress of color printer technology. Ink-jet technology and sublimation type printer technology can provide high quality color images, but they print at a low speed. On the contrary, electrophotography technology can print a color image with high speed, but provides a low quality color image.

There is a Tandem method to realize high speed printing, as one of the color image formation methods using electrophotography technology. The Tandem method includes four image forming units arranged in parallel (each unit made up of a photosensitive drum, a charging unit, an exposure unit, and a development unit) corresponding to yellow, magenta, cyan, and black. In the Tandem method, each color image is transferred onto an image receptor sheet (or a printing sheet) in turn after each color development has been completed. Although this method can print color images on the printing sheet with high speed, it is difficult to obtain a high quality color image on the printing sheet because it is difficult to position each color image on the printing sheet accurately.

On the contrary, there is a well known dry-toner-type electrophotographic method of forming each of four color toner images onto a photosensitive layer placed on the outer surface of a photosensitive drum by four image forming units corresponding to each of the four colors, developing these toner images superimposed on the photosensitive layer, and then transferring those images onto a printing sheet at once (hereinafter, referred to as "Image on image development method"). In this method, during the rotation of the photosensitive drum, four color toner images can be formed on the photosensitive layer with high speed like the speed of the Tandem method. In addition, the method has another feature to keep the positioning of each toner color precise. Therefore this method can also provide a high quality color image.

However, this conventional dry-toner-type electrophotographic method has essential problems that make it difficult to obtain high quality color images. For example, the quality of the color print image is reduced because toner images are scattered while the plural color toners are superimposed on the photosensitive layer when the image on image development method is used.

This is the phenomenon in which a previously developed toner image on the photosensitive layer is scattered during the process of forming a subsequent color image. The reason is as follows:

After developing the previous toner image, when the photosensitive layer is charged and the selective-exposure is performed to the image forming region for the subsequent toner, a large-voltage potential difference is generated at the boundary area between an exposed area and an unexposed area which are adjacent to each other. This generates a large electric field along a lateral direction. At this time, when the previously developed toner is present in the unexposed area adjacent to the exposed area, the previously developed toner is scattered by a strong electrostatic force in the lateral direction caused by the electric field.

As described above, the conventional dry-toner-type color electrophotographic devices using toner powders have the drawback that it is difficult to obtain a desired high-quality print image by applying the image on image development method because the previously developed toner is scattered during the development process for the subsequent toner image.

SUMMARY OF THE INVENTION

Accordingly, an object of the present invention is, with due consideration to the drawbacks of the conventional technique, to provide an electrophotographic device capable of outputting a high quality color image with high speed even if the image on image development method is used.

In accordance with an embodiment of the present invention, an electrophotographic device comprises a photosensitive layer formed on a photosensitive drum, charging units, exposure units, development units, a transfer section, detectors, and a control section which controls the operations of these configuration elements. The control section controls operations of at least one or more of the charging units, the exposure units, and the development units in order to obtain forces satisfying a relationship designated by a following inequality, in which these forces are applied to a previously developed toners close to selectively-exposed subsequent toners where no previously developed toners are present, wherein the previously developed toner area is not exposed during this selective exposure process performed after the completion of the charging process by the charging unit after the completion of the development for the previous toner by the previous development unit, $$q\frac{\Delta V}{10^{-4}} \leq \frac{R}{12D^2}\left[\frac{3kT}{4}\left(\frac{\varepsilon_t-\varepsilon_m}{\varepsilon_t+\varepsilon_m}\right)^2+\frac{3hV_e}{16\sqrt{2}}\frac{(n_t^2-n_m^2)^2}{(n_t^2+n_m^2)^{\frac{3}{2}}}\right]-\frac{1}{4\pi\varepsilon_m\varepsilon_0}\frac{q^2}{R^2},$$

where q is a toner charge per previously developed toner, ΔV is a voltage difference between a surface voltage Vo of the previously developed toner after the completion of the subsequent charging process and a surface voltage VL at a selectively-exposed area, R is a radius of a previously developed toner, D is a distance between previously developed toners (a surface distance), $\epsilon_t$ and $n_t$ are a relative dielectric constant and a refractive index of the previously developed toner, respectively, $\epsilon_m$ and $n_m$ are a relative dielectric constant and a refractive index of a medium in which the previously developed toners are present, respectively, k is Boltzmann's constant, "T" is absolute temperature, "$\epsilon_0$" is a dielectric constant of a vacuum, "h" is Planck's constant, and "$V_e$" is a toner-absorption frequency.

BRIEF DESCRIPTION OF THE DRAWINGS

These and other objects, features, aspects and advantages of the present invention will become more apparent from the following detailed description of the present invention when taken in conjunction with the accompanying drawings, in which.

DETAILED DESCRIPTION OF THE PREFERRED EMBODIMENTS

Other features of this invention will become apparent through the following description of preferred embodiments which are given for illustration of the invention and are not intended to be limiting thereof.

First Embodiment

Figure 1:
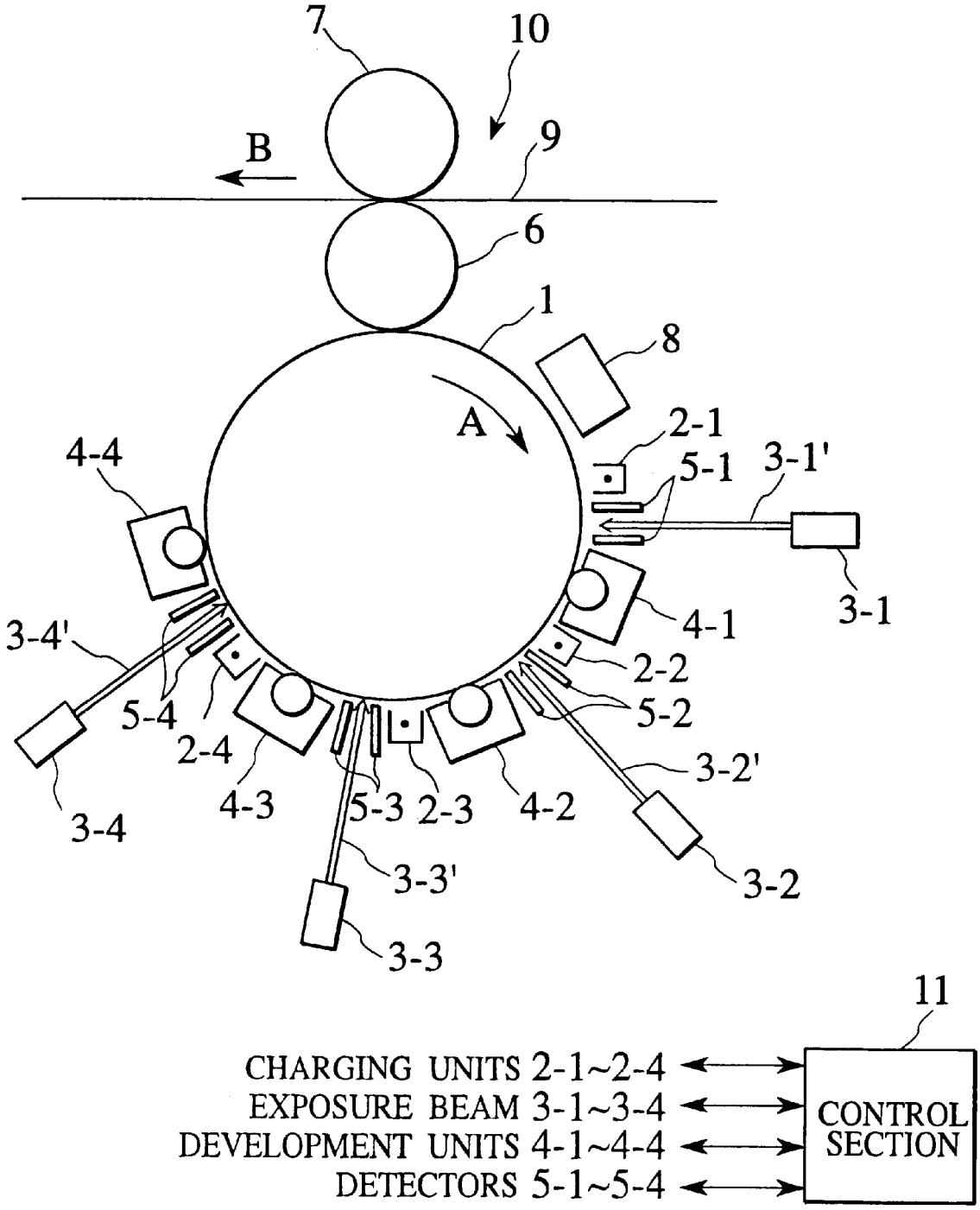
FIG. 1 is a schematic view showing a configuration of an electrophotographic device according to an embodiment of the present invention.

FIG. 1 is a schematic view showing a configuration of an electrophotographic device according to an embodiment of the present invention. The electrophotographic device shown in FIG. 1 comprises a photosensitive drum 1 supported rotatably, charging units 2-1 to 2-4, exposure units 3-1 to 3-4, development units 4-1 to 4-4, detectors 5-1 to 5-4, an intermediate transfer roller (as an intermediate transfer body) 6, a pressure roller 7, a cleaner 8, a transfer unit 10, and a control section 11. Those units 2-1 to 2-4, 3-1 to 3-4, 4-1 to 4-4, 5-1 to 5-4, 6, and 7 are arranged around the photosensitive drum 1. The control section 11, which comprises a central processing unit (CPU) in an actual case, for example, controls the operations of the charging units 2-1 to 2-4, the exposure units 3-1 to 3-4, the development units 4-1 to 4-4, the detectors 5-1 to 5-4, the intermediate transfer roller 6, the press 7, the cleaner 8, and the transfer unit 10.

In the configuration shown in FIG 1, the charging units 2-1 to 2-4, the exposure units 3-1 to 3-4, the development units 4-1 to 4-4, and the detectors 5-1 to 5-4 are grouped per color. For example, the charging unit 2-1, the exposure unit 3-1, the development unit 4-1, and the detector 5-1 are provided for Yellow color. Similarly, the charging unit 2-2, the exposure unit 3-2, the development unit 4-2, and the detector 5-2 are provided for Magenta color, the charging unit 2-3, the exposure unit 3-3, the development unit 4-3, and the detector 5-3 are provided for Cyan color, and the charging unit 2-4, the exposure unit 3-4, the development unit 4-4, and the detector 5-4 are provided for Black color.

The exposure units 3-1 to 3-4 apply exposure beams 3-1' to 3-4' that have been modulated in accordance with image data onto the corresponding surface of the photosensitive layer formed on the photosensitive drum 1, respectively.

The transfer unit 10 (of a thermal and pressure transfer method) comprises the intermediate transfer roller 6 (as an intermediate transfer body), and the pressure roller 7 for pressing the intermediate transfer roller 6 through a printing sheet 9.

Each of the detectors 5-1 to 5-4 detects a toner charge and a surface voltage of a corresponding area in the photosensitive layer formed on the photosensitive drum 1.

Next, a description will be given of the operation of the electrophotographic device according to the embodiment.

The photosensitive drum 1 is a drum comprising a conductive substrate and a photosensitive layer made up of an organic material or an inorganic material such as amorphous silicon formed on the conductive substrate.

A well-known corona charging unit 2-1 (Corotron charger or Scorotron charger, for example) performs uniform charging of the photosensitive layer on the photosensitive drum 1 and a laser beam or an LED beam as an exposure beam 3-1' modulated is irradiated onto the photosensitive layer in order to form an electrostatic latent image thereon. After the formation of the latent image on the photosensitive layer, the development unit 4-1 containing a liquid developer develops the latent image in order to visualize the image.

Following this, the second electrostatic latent image is formed on the photosensitive layer by the second charging unit 2-2 and the second exposure beam 3-2', and then developed by the second development unit 4-2 containing a developer that is different in color from the developer in the first development unit 4-1. Accordingly, after this second development process, two-color toner images (yellow and magenta) are formed on the photosensitive layer on the photosensitive drum 1. In the same manner as mentioned above, two-color toner images (cyan and black) are formed and developed by the third and fourth development units 4-3 and 4-4. Finally, a full-color toner image is obtained on the photosensitive layer of the photosensitive drum 1.

After this, the full-color toner image formed on the photosensitive drum 1 is transferred to the printing sheet 9 by the transfer unit 10. In this transfer process, the full-color toner image can be transferred directly to the printing sheet 9, or transferred to the printing sheet 9 through the intermediate transfer roller 6 shown in FIG. 1. It is possible to transfer the color toner image by electric-field or by pressure (namely, offset transfer) from the photosensitive drum 1 to the intermediate transfer roller 6 and from the intermediate transfer roller 6 to the printing sheet 9.

Figure 2:
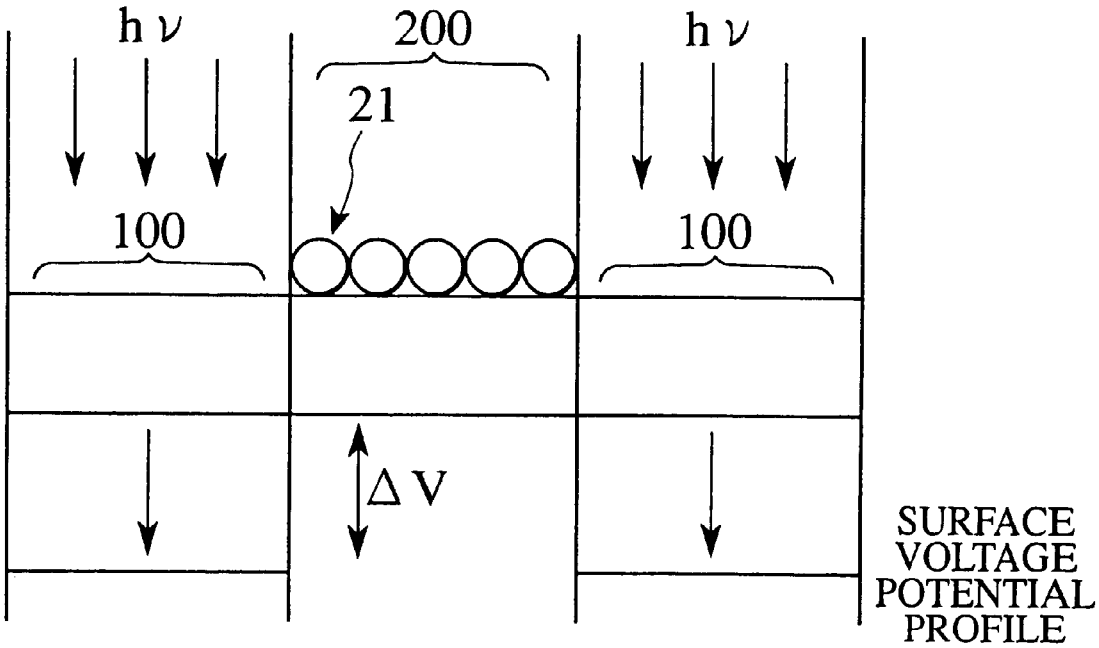
FIG. 2 is a schematic view showing a state of previously developed toners formed on a photosensitive drum shown in FIG. 1.

Although most of the liquid toners can be fixed on the printing sheet at room temperature, it is possible to use thermal fixing by heating the pressure roller 7. After the transfer process of the image to the printing sheet 9, the cleaner 8 removes the remaining toners on the photosensitive drum 1. The inventors of the present invention studied the method of obtaining a desired high-quality image on a printing sheet without toner scattering in the previously-developed toner image formed on the photosensitive layer on the photosensitive drum 1 during the subsequent toner image development process based on the image on image development method performed by the electrophotographic device having the configuration described above. As a result, the inventors discovered the following fact:

As shown in FIG. 2, when the subsequent selective exposure process is performed in the image forming process of the subsequent toner, the previously developed toners 21 are scattered most easily in the case that the previously developed toners 21 exist in the non-exposed area 200 which is adjacent to the exposed area 100 and no previously developed toner exists in the exposed area 100. That is, this fact shows that if it is possible to suppress the scattering of the previously developed toners 21 in the case shown in FIG. 2, the amount of scattering the previously developed toners in various cases can be reduced.

The following forces (A) to (D) may be applied to toners in a lateral direction:

(A) Van der Waals force (Fv) between previously developed toners;

(B) Electrostatic repulsive force (Fr) between previously developed toners;

(C) Electrostatic force (Fe) in a lateral direction generated by selective exposure; and (D) Frictional force (Ff) between toner and the photosensitive layer.

The relationship among those forces Fv, Fr, Fe, Ff determines the amount of scattering of the previously developed toners.

Figure 3:
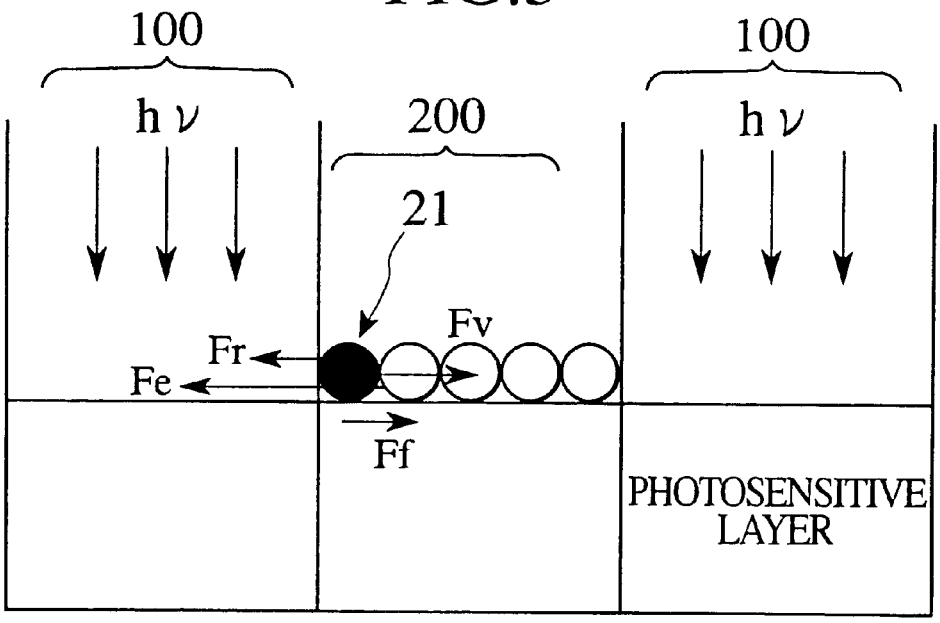
FIG. 3 is a schematic view showing a relationship among various forces Fr, Fe, Fv, and Ff applying the previously developed color toners formed on the photosensitive drum shown in FIG. 1 during the selective exposure process for subsequent toners.

The forces Fv and Fr in the previously developed toner image under the state shown in FIG. 3 can be expressed by the following equations (1) and (2).

$$Fv = \frac{R}{12D^2}\left[\frac{3kT}{4}\left(\frac{\varepsilon_t - \varepsilon_m}{\varepsilon_t + \varepsilon_m}\right)^2 + \frac{3hV_e}{16\sqrt{2}}\frac{(n_t^2 - n_m^2)^2}{(n_t^2 + n_m^2)^{\frac{3}{2}}}\right], \quad \text{and} \tag{1}$$

$$Fr = -\frac{1}{4\pi\varepsilon_m\varepsilon_0}\frac{q^2}{R^2}, \tag{2}$$

where R is a radius of a previously developed toner, D is a distance between previously developed toners (a surface distance), $\epsilon_t$ and $n_t$ are a relative dielectric constant and a refractive index of the previously developed toners, respectively, $\epsilon_m$ and $n_m$ are a relative dielectric constant and a refractive index of a medium in which the previously developed toners are present, respectively, k is Boltzmann's constant, "T" is absolute temperature, "$\epsilon_0$" is a dielectric constant of vacuum, "h" is Planck's constant, and "$V_e$" is a toner-absorption frequency.

On the other hand, since it is difficult to quantize both the forces "Fe" and "Ff", an effective electrostatic force Feff expressed by the following equation (3) is used as index instead of "Fe" and "Ff". Thereby, the mutual relationship between the inequality of Feff and Fv+Fr and the scattering of the previously developed toner is investigated experimentally. Of course, Fv+Fr can be quantized by using the equations (1) and (2).

$$Feff = q\frac{\Delta V}{10^{-4}}, \tag{3}$$

where "q" is a toner charge per previously developed toner, and "ΔV" is a voltage difference between a surface voltage "Vo" of the previously developed toner after the completion of the subsequent charging process and a surface voltage "VL" at a selectlvely-exposed area. This experiment shows that it is possible to greatly suppress the scattering of the previously developed toners and to obtain a high quality color image if the toner charge and the radius of a toner are controlled so that the following relationship (4) is satisfied:

$$Feff \leqq Fv + Fr \tag{4}$$

Here, when the equations (1), (2), and (3) are inserted into the relationship (4), the following relationship (5) can be obtained:

$$q\frac{\Delta V}{10^{-4}} \leq \frac{R}{12D^2}\left[\frac{3kT}{4}\left(\frac{\varepsilon_t - \varepsilon_m}{\varepsilon_t + \varepsilon_m}\right)^2 + \frac{3hV_e}{16\sqrt{2}}\frac{(n_t^2 - n_m^2)^2}{(n_t^2 + n_m^2)^{\frac{3}{2}}}\right] - \frac{1}{4\pi\varepsilon_m\varepsilon_0}\frac{q^2}{R^2}. \tag{5}$$

In this case, because ΔV is a voltage difference between a surface voltage "VL" of the previously developed toner after the completion of the subsequent charging process and a surface voltage at a selectively exposed area, the left-side value ($q(\Delta V/10^{-4})$) in the equation (5) can be adjusted by controlling the value "ΔV" based on the power of the charging units 2-1 to 2-4 and the level of the exposure beams 3-1' to 3-4', and further by adjusting the toner charge "q" per previously developed toner.

In addition, because the right-side value of the equation (5) can be adjusted by controlling a radius "R" of a toner, a relative dielectric constant "$\epsilon_t$", a refractive index "$n_t$", and a toner charge "q" of a toner, the relationship (5) can be satisfied by controlling the above values.

As a concrete example, the control section 11 controls the operation of the charging units 2-1 to 2-4, the exposure units 3-1 to 3-4, the development units 4-1 to 4-4, and the detectors 5-1 to 5-4. In particularly, the control section 11 controls the operation of the charging units 2-1 to 2-4, the exposure units 3-1 to 3-4, and the development units 4-1 to 4-4 based on detection signals transferred from the detectors 5-1 to 5-4 per printing in order to adjust the toner charge "q" per toner, and the voltage difference ΔV between the surface voltage Vo of the previously developed toner and the surface voltage VL at the selectively exposed area. It is possible to set optimum values as initial values per electrophotographic device, or it is also possible to set optimum values as initial values according to types of toners to be used. In these cases, it is possible to eliminate the detectors from the configuration of the electrophotographic device.

By the way, because the following values are changeable according to the kind of toner, they are determined before printing:

Radius R of a toner; Distance D between adjacent toners (or the distance between surfaces of adjacent toners); Positive dielectric constant $\epsilon_t$ and Refractive index $n_t$ of a toner; Relative dielectric constant $\epsilon_m$ and Refractive index $n_m$ in a medium in which previously developed toners are present; and toner-absorption frequency Ve.

Next, an actual embodiment according to the present invention and a comparative example will be described in detail.

This embodiment uses a liquid developer in which a cyanine pigment is added to an acrylic resin and then it to dispersed in Isoper-L (Exxon chemical Co., Ltd) as a hydrocarbon solvent. In this embodiment, an average grain size (diameter) of the toner particle is 0.8 μm, a toner charge-to-mass ratio of the toner is 100 μC/g, and a density of the toner is 1.4 g/cm$^3$, the temperature is 300 K. By using this liquid developer, the electrophotographic device shown in FIG. 1 forms and develops ten patterns on the photosensitive layer, each pattern is a square of 5 mm×5 mm. After the completion of this pattern formation, the photosensitive layer is charged and then exposed selectively for areas excepting the area of the ten patterns. Finally, the amount of toners scattered from the toner images formed on the ten patterns is evaluated quantitatively. The charging units and the exposure units are adjusted so that the surface voltage Vo of the toner is set to be 600V, and the surface voltage VL at the selectively exposed area is set to be 100V.

More specifically, at first, the ten patterns (each size is a square of 5 mm×5 mm) are formed as a standard sample on the photosensitive layer. At this time, the toner image of the ten patterns is separated from the photosensitive layer by using a peeling tape. This tape is then detected optically in order to measure the area of the ten patterns. The area of the ten patterns optically measured will be used as a standard area "So".

On the other hand, a test sample is prepared as follows.

Similar to the formation of the standard sample, ten patterns (each pattern is a square of 5 mm×5 mm) are developed on the photosensitive layer, and the photosensitive layer is then charged and the selective exposure is performed. Further, the toner image of the ten patterns is separated from the photosensitive layer by using a peeling tape. This tape is then detected optically in order to measure the area of the ten patterns. The area "S" of the ten patterns of the test sample optically measured is obtained.

The amount of the scattered toner in the toner image is detected by using the following equation:

$$J=100\times(S-So)\div So.$$

As a result, J=1 is obtained in this first embodiment. This result indicates that the amount of the scattered toners is very low.

On the other hand, the values Fv, Fr, and Feff are calculated by using physical properties of the toner and the development process condition values. In this calculation, the radius of a toner is 0.4 $\mu$m(R=0.4 $\mu$m), the distance of adjacent toners (distance between both surfaces)is 0.4 nm (D=0.4 nm), the relatlve dielectric constant $\epsilon_t$ of the toner is 4 ($\epsilon_t$=4), the refractive index $n_t$ of the toner is 1.479 ($n_t$=1.479), the relative dielectric constant $\epsilon_m$ of Isoper-L (Exxon chemical Co., Ltd) is 2 ($\epsilon_m$=2), the refractive index $n_m$ of Isoper-L is 1.428 ($n_m$=1.428), the toner charge q (this value was calculated based on the toner charge-to-mass ratio and the density obtained above) per toner is 3.75×10E−17 (c) (q=3.75×10E−17 (C)), the toner absorption frequency is $2.9\times10^{15}$ $^{(S-1)}$). The values Fv, Fr, and Feff can be obtained based on those values as follows:

$$Fv=2.1\times10E-10(N),$$

$$Fr=-1.0\times10E-11(N),$$

and $$Feff=1.9\times10E-10(N).$$

Thus, this embodiment of the present invention can satisfy the relationship (Feff<=Fv+Fr) indicated by the above equation (4), so that it is recognized that the adhered force between adjacent toners becomes strong and the amount of scattering of toners can be reduced.

Comparison Example

In the process of this comparison example to measure the amount of scattering of toners, the same manner of the embodiment described above Is used other than the use of a dry-toner (Acryl-styrene resin adhered with Cyanogens pigment).

An average grain size (diameter) of the toner is 10 $\mu$m, a specific charge of the toner is 15 $\mu$C/g, and a density of the toner is 1.4 g/cm$^3$. In the comparison example, the amount of the scattered toners becomes 18 (J−18). This result indicates that the toner image in the comparison example was scattered remarkably when compared with the embodiment.

On the other hand, the values Fv, Fr, and Feff are calculated by using physical properties of the toner and the development process condition values. In this calculation for the comparison example, the radius of a toner is 5 $\mu$m(R=5 $\mu$m), the distance of adjacent toners (distance between both surfaces) is 1.0 nm (D=1.0 nm), the relative dielectric constant $\epsilon_t$ of the toner is 4($\epsilon_t$=4), the refractive index $n_t$ of the toner is 1.479 ($n_t$=1.479), the relative dielectric constant $\epsilon_m$ of air is 1 ($\epsilon_m$=1), the refractive index $n_m$ of air is 1 ($n_m$=1), the toner charge q (this value was calculated based on the toner charge-to-mass ratio and the density obtained above) per toner is 1.1×10E−14 (C) (q=1.1×10E−14 (C)), the toner-absorption frequency is $2.9\times10^{15}$ ($S^{-1}$). The values Fv, Fr, and Feff can be obtained based on those values as follows:

$$Fv=2.7\times10E-8(N),$$

$$Fr=-1.1\times10E-8(N),$$

and $$Feff-5.5\times10E-8(N).$$

Thus, the comparison example satisfies the following relationship: Feff>Fv+Fr.

This result means that the adhered force between toners is not adequately larger than the effective electrostatic force Feff based on the electrical field generated in a lateral direction, so that the scattering of toner occurs.

As described above, according to the embodiment of the present invention, the previously developed toners are not scattered even if a large electrostatic force generated in the subsequent selective exposure process is applied to them.

It is thereby possible to obtain a high quality color print image with a high speed based on the image on image development method. Furthermore, because a liquid toner having an extremely fine particle can be used, that is a main advantage of the electrophotographic device of the liquid toner type, when compared with dry toners, it is possible to provide a high quality and adequate density color image with a small amount of toners. The configuration and function of the electrophotographic device of the embodiment can reduce the economical cost of printing because the electrophotographic device of the present invention can obtain high quality printed images comparable with photochromography printing and can fix the toners onto a printing sheet with a relatively low temperature.

In addition, although the detectors 5-1 to 5-4 are provided per color toner in the configuration shown in FIG. 1, it is possible to eliminate the detectors 5-1 to 5-4, or to provide the detectors for color toners other than the black toner.

Similarly, although the combination of a charging unit, an exposure unit, and a development unit are provided for each color of toner in the configuration shown in FIG. 1, it is possible to provide them only for three color toners of yellow, magenta, and cyan other than black, or to change this combination to a desired combination according to applications. This can achieve the same effect.

The embodiment described above shows the electrophotographic device of a liquid toner type, but, the present invention is not limited by this, for example, it is apparently possible to apply electrophotographic devices of dry toner type and to obtain the same effects if a control section controls various values such as the radius of a dry toner and the toner charge so that the relationship (5) is satisfied.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. An electrophotographic device for transferring, onto a receptor sheet, a plural color toner image superimposed on a photosensitive layer after image development of a plurality of color toners, comprising:

a photosensitive layer configured to receive an electrostatic latent image;

one or more charging units configured to charge the photosensitive layer;

one or more exposure units configured to form an electrostatic latent image on the photosensitive layer by exposing a selected area on the photosensitive layer using an image modulated light beam;

one or more development units configured to supply a developer to the electrostatic latent image to form a toner image on the photosensitive layer;

a transfer unit configured to transfer the toner image to the receptor sheet;

one or more detectors configured to detect physical values on the photosensitive layer; and a control section configured to control at least one operation of at least one or more of the charging units, the exposure units, and the development units to obtain forces satisfying a relationship designated by the following inequality, wherein the forces are applied to previously developed toner areas close to selectively-exposed subsequent toner areas where no previously developed toner areas are present, wherein previously developed toner areas are not exposed during a selective exposure process performed after completion of a charging process by the charging unit after completion of development for the previously developed toner areas by the previous development unit, $$q\frac{\Delta V}{10^{-4}} \leq \frac{R}{12D^2}\left[\frac{3kT}{4}\left(\frac{\varepsilon_t-\varepsilon_m}{\varepsilon_t+\varepsilon_m}\right)^2+\frac{3hV_e}{16\sqrt{2}}\frac{(n_t^2-n_m^2)^2}{(n_t^2+n_m^2)^{\frac{3}{2}}}\right]-\frac{1}{4\pi\varepsilon_m\varepsilon_0}\frac{q^2}{R^2},$$

where q is a toner charge per previously developed toner areas, ΔV is a voltage difference between a surface voltage Vo of the previously developed toner areas after completion of the charging process and a surface voltage VL at the selectively-exposed subsequent area, R is a radius of the previously developed toner areas, D is a distance between the previously developed toner areas (a surface distance), $\epsilon_t$ and $n_t$ are a relative dielectric constant and a refractive index of the previously developed toner, respectively, $\epsilon_m$ and $n_m$ are a relative dielectric constant and a refractive index in a medium in which the previously developed toner areas are present, respectively, k is Boltzmann's constant, "T" is absolute temperature, "$\epsilon_0$" is a dielectric constant of a vacuum, "h" is Planck's constant, and "$V_e$" is a toner-absorption frequency.

2. The electrophotographic device according to claim 1, wherein toners having a radius R, a relative dielectric constant $\epsilon_t$, and a refractive index $n_t$ as initial values are selected to determine the right side of the inequality, and wherein the control section is configured to control at least one or more of the power of the charging units, the exposure level of the exposure units, and the toner charge q per toner based on the toner charge q and the voltage difference ΔV detected by the detectors to satisfy the left side of the inequality.

3. The electrophotographic device according to claim 1, wherein the transfer unit contains an intermediate transfer member, the plural color toner image superimposed on the photosensitive layer is transferred to the intermediate transfer member, and the toner image on the intermediate transfer member is transferred to the receptor sheet.

4. The electrophotographic device according to claim 3, wherein the intermediate transfer member is configured to contact the photosensitive layer.

5. The electrophotographic device according to claim 1, wherein the plurality of color toners include four color toners such as yellow color toner, magenta color toner, cyan color toner, and black color toner, and wherein the combination of the charging unit, the exposure unit, the development unit, and the detector is provided per color toner and each combination is configured to be placed in parallel around the photosensitive layer.

6. The electrophotographic device according to claim 1, wherein the plurality of color toners include four color toners such as yellow color toner, magenta color toner, cyan color toner, and black color toner, and wherein the combination of the charging unit, the exposure unit, and the development unit is provided per color toner and each combination is configured to be placed in parallel around the photosensitive layer.

7. The electrophotographic device according to claim 1, wherein the plurality of color toners include three color toners such as yellow color toner, magenta color toner, and cyan color toner, and wherein the combination of the charging unit, the exposure unit, and the development unit is provided per color toner and each combination is configured to be placed in parallel around the photosensitive layer.

8. The electrophotographic device according to claim 1, wherein each exposure unit includes a laser device for outputting a laser beam in order to form the electrostatic latent image on the photosensitive layer based on the control of the control section.

9. The electrophotographic device according to claim 1, wherein each exposure unit includes a light emitting diode (LED) for outputting a LED beam to form the electrostatic latent image on the photosensitive layer based on the control of the control section.

10. The electrophotographic device according to claim 1, wherein the electrophotographic device is an electrophotographic device of a liquid type using plural liquid color toners.

11. The electrophotographic device according to claim 10, wherein toners having a radius R, a relative dielectric constant $\epsilon_t$, and a relative index nt as initial values are selected in order to determine the right side of the inequality, and wherein the control section is configured to control at least one or more of the power of the charging units, the exposure level of the exposure units, and the toner charge q per toner based on the toner charge q and the voltage difference ΔV detected by the detectors in order to satisfy the left side of the inequality.

12. The electrophotographic device according to claim 10, wherein the transfer unit contains an intermediate transfer member, and the plural color toner image superimposed on the photosensitive layer is transferred to the intermediate transfer member in a first transfer process, and the toner image on the intermediate transfer member is transferred to the receptor sheet in a second transfer process.

13. The electrophotographic device according to claim 12, wherein the intermediate transfer member is configured to contact the photosensitive layer and the receptor sheet in the first and the second transfer process, respectively.

14. The electrophotographic device according to claim 10, wherein the plurality of color toners include four color toners such as yellow color toner, magenta color toner, cyan color toner, and black color toner, and wherein the combination of the charging unit, the exposure unit, the development unit, and the detector is provided per color toner and each combination is configured to be placed in parallel around the photosensitive layer.

15. The electrophotographic device according to claim 10, wherein the plurality of color toners include four color toners such as yellow color toner, magenta color toner, cyan color toner, and black color toner, and wherein the combination of the charging unit, the exposure unit, and the development unit is provided per color toner and each combination is configured to be placed in parallel around the photosensitive layer.

16. The electrophotographic device according to claim 10, wherein the plurality of color toners include three color toners such as yellow color toner, magenta color toner, and cyan color toner, and wherein the combination of the charging unit, the exposure unit, the development unit, and the detector is provided per color toner and each combination is configured to be placed in parallel around the photosensitive layer.

17. The electrophotographic device according to claim 10, wherein each exposure unit is a laser device for outputting a laser beam in order to form the electrostatic latent image on the photosensitive layer based on the control of the control section.

18. The electrophotographic device according to claim 10, wherein each exposure unit includes a light emitting diode (LED) for outputting a LED beam in order to form the electrostatic latent image on the photosensitive layer based on the control of the control section.

* * * * *